US012089685B2

(12) United States Patent
Allen et al.

(10) Patent No.: US 12,089,685 B2
(45) Date of Patent: Sep. 17, 2024

(54) PROTECTIVE HELMET WITH MULTIPLE ENERGY MANAGEMENT LINERS

(71) Applicant: Bell Sports, Inc., Scotts Valley, CA (US)

(72) Inventors: Scott R. Allen, Scotts Valley, CA (US); James R. Penny, Santa Cruz, CA (US); Alexander J. Szela, Santa Cruz, CA (US); Julio Valencia, Santa Cruz, CA (US); Christopher T. Pietrzak, Ben Lomond, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 864 days.

(21) Appl. No.: 16/675,128

(22) Filed: Nov. 5, 2019

(65) Prior Publication Data

US 2020/0187583 A1 Jun. 18, 2020

Related U.S. Application Data

(63) Continuation of application No. 15/374,597, filed on Dec. 9, 2016, now Pat. No. 10,463,099.

(Continued)

(51) Int. Cl.
*A42B 3/06* (2006.01)
*A42B 3/12* (2006.01)

(Continued)

(52) U.S. Cl.
CPC ..... *A42B 3/064* (2013.01); *A42B 3/061* (2013.01); *A42B 3/065* (2013.01); *A42B 3/127* (2013.01);

(Continued)

(58) Field of Classification Search
CPC ..... A42B 3/061; A42B 3/063; A42B 3/064; A42B 3/065; A42B 3/066; A42B 3/127; A42B 3/283; A42B 1/10
See application file for complete search history.

(56) References Cited

U.S. PATENT DOCUMENTS 4,307,471 A * 12/1981 Lovell ..... A42B 3/12 2/425
5,056,156 A * 10/1991 Kosmo ..... B32B 27/365 428/419

(Continued)

OTHER PUBLICATIONS

Surface Roughness, https://engineering.purdue.edu/ME556/Documents/Surface%20Roughness.pdf <https://engineering.purdue.edu/ME556/Documents/Surface Roughness.pdf>.

*Primary Examiner* — Heather Mangine
*Assistant Examiner* — Raquel M. Weis
(74) *Attorney, Agent, or Firm* — Reed Smith LLP; Walter M. Egbert, III; Anupma Sahay

(57) ABSTRACT

A helmet for rotational energy management can include an outer energy management layer comprising an outer surface and an inner surface opposite the outer surface. The inner surface can comprise a first slidable finish comprising a first glaze comprising a thickness less than or equal to 2 millimeters (mm). An inner energy management layer can be disposed within the outer energy management layer and further comprise an outer surface oriented towards the outer energy management layer and an inner surface opposite the outer surface. The outer surface can comprise a second slidable finish that directly contacts the first slidable finish. The second slidable finish can comprise a second glaze comprising a thickness less than or equal to 2 mm. A space between the first slidable finish and the second slidable finish can be devoid of a lubricant and devoid of any interstitial slip layer.

20 Claims, 3 Drawing Sheets

Related U.S. Application Data

(60) Provisional application No. 62/266,172, filed on Dec. 11, 2015.

(51) Int. Cl.
*A42B 3/28* (2006.01)
*A63B 71/10* (2006.01)

(52) U.S. Cl.
CPC ..... *A42B 3/283* (2013.01); *A63B 71/10* (2013.01); *A42B 3/066* (2013.01)

(56) References Cited

U.S. PATENT DOCUMENTS 5,551,094 A * 9/1996 Navone ..... A42B 3/121 2/418
5,687,426 A * 11/1997 Sperber ..... A42B 3/066 2/413
5,956,777 A * 9/1999 Popovich ..... A42B 3/20 2/9
6,282,724 B1 * 9/2001 Abraham ..... A41D 13/015 2/455
6,446,270 B1 * 9/2002 Durr ..... A42B 3/20 2/412
6,658,671 B1 * 12/2003 Von Holst ..... A42B 3/064 2/412
7,879,418 B1 * 2/2011 Komvopoulos ..... B05D 1/60 428/36.9
8,156,569 B2 * 4/2012 Cripton ..... A42B 3/0473 2/6.8
8,316,512 B2 * 11/2012 Halldin ..... A42B 3/064 24/90.1
10,463,099 B2 * 11/2019 Allen ..... A42B 3/283
2001/0032351 A1 * 10/2001 Nakayama ..... A42B 3/064 2/412
2002/0023291 A1 * 2/2002 Mendoza ..... A42B 3/064 2/412
2004/0117896 A1 * 6/2004 Madey ..... A42B 3/064 2/425
2004/0250340 A1 * 12/2004 Piper ..... A42B 3/064 2/412
2005/0015855 A1 * 1/2005 Skiba ..... A42B 3/063 2/412
2006/0059605 A1 * 3/2006 Ferrara ..... A42B 3/064 2/412
2007/0099524 A1 * 5/2007 Porter ..... B32B 5/24 442/381
2008/0066217 A1 * 3/2008 Depreitere ..... A42B 3/124 2/412
2011/0299025 A1 * 12/2011 Sahouani ..... G02F 1/133711 156/247
2012/0060251 A1 * 3/2012 Schimpf ..... A42B 3/064 2/5
2012/0096631 A1 * 4/2012 King ..... A42B 3/064 2/410
2012/0186003 A1 * 7/2012 Heger ..... A41D 13/015 188/267.2
2012/0208032 A1 * 8/2012 Faden ..... B32B 5/16 428/688
2012/0233745 A1 * 9/2012 Veazie ..... A42B 3/125 2/413
2012/0297526 A1 * 11/2012 Leon ..... A63B 71/10 2/413
2013/0019384 A1 * 1/2013 Knight ..... A42B 3/063 2/455
2013/0019385 A1 * 1/2013 Knight ..... A41D 13/015 2/411
2013/0040524 A1 * 2/2013 Halldin ..... B32B 5/26 442/326
2013/0042397 A1 * 2/2013 Halldin ..... A42B 3/12 2/411
2013/0122256 A1 * 5/2013 Kleiven ..... B32B 5/16 428/158
2013/0247284 A1 * 9/2013 Hoshizaki ..... A42B 3/12 2/413
2013/0340151 A1 * 12/2013 Bradley ..... A42B 3/28 2/425
2014/0013492 A1 * 1/2014 Bottlang ..... A42B 3/125 2/414
2014/0090155 A1 * 4/2014 Johnston ..... A42B 3/064 2/414
2014/0109299 A1 * 4/2014 Kwan ..... A42B 3/121 2/455
2014/0109304 A1 * 4/2014 Kwan ..... A41D 13/015 2/455
2014/0189945 A1 * 7/2014 Golnaraghi ..... F16F 7/12 2/455
2014/0201889 A1 * 7/2014 Pietrzak ..... A42C 2/007 2/410
2015/0089725 A1 * 4/2015 Lowe ..... A42B 3/125 2/410
2015/0157083 A1 * 6/2015 Lowe ..... A42B 3/128 2/412
2015/0223547 A1 * 8/2015 Wibby ..... A42B 3/064 2/414
2015/0250253 A1 * 9/2015 Jacobsen ..... A42B 3/221 2/411
2015/0257472 A1 * 9/2015 Burek ..... A42B 3/125 2/425
2016/0316847 A1 * 11/2016 Weber ..... A42B 3/064
2017/0164678 A1 * 6/2017 Allen ..... A42B 3/064

* cited by examiner

PROTECTIVE HELMET WITH MULTIPLE ENERGY MANAGEMENT LINERS

RELATED APPLICATIONS

This application is a continuation application of earlier U.S. utility patent application Ser. No. 15/374,597, filed Dec. 9, 2016 titled "Protective Helmet with Multiple Energy Management Liners," which application claims the benefit of U.S. provisional patent application 62/266,172, filed Dec. 11, 2015 titled "Protective Helmet with Multiple Energy Management Liners," the entirety of the disclosures of which are incorporated herein by this reference.

TECHNICAL FIELD

This disclosure relates to a protective helmet comprising multiple energy management liners.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

Protective headgear and helmets sometimes comprise multiple layers of energy management materials. In some instances, helmets comprising multiple layers of energy management materials have included lubricants or extra low-friction layers or liners disposed between the multiple layers of energy management materials. The lubricants or extra low-friction layers or liners have been used to provide relative movement, slipping, or rotation between the two energy management liners.

SUMMARY

A need exists for an improved helmet comprising multiple energy management liners that slip or rotate effectively against one another. Accordingly, in an aspect, a protective helmet for rotational energy management can comprise an outer energy management layer comprising an outer surface and an inner surface opposite the outer surface. The inner surface can comprise a first slidable finish comprising a first glaze comprising a thickness less than or equal to 2 millimeters (mm). An inner energy management layer can be disposed within the outer energy management layer and can further comprise an outer surface oriented towards the outer energy management layer and an inner surface opposite the outer surface. The outer surface can comprise a second slidable finish that directly contacts the first slidable finish, the second slidable finish comprising a second glaze comprising a thickness less than or equal to 2 mm. A space between the first slidable finish and the second slidable finish can be devoid of a lubricant and devoid of any interstitial slip layer to facilitate relative movement between the first slidable finish and the second slidable finish at a time of impact.

The protective helmet can further comprise the first glaze comprising a thickness less than or equal to 1 mm, and the second glaze comprising a thickness less than or equal to 1 mm. The first slidable finish and the second slidable finish can comprise surface texture skewness of less than or equal to 1 mm. The outer energy management layer can comprise expanded polystyrene (EPS), expanded polypropylene (EPP), expanded polyurethane (EPU), or expanded polyolefin (EPO), and the glaze of the first slidable finish can comprise EPS, EPP, EPU, or EPO. The inner energy management layer can comprise EPS, EPP, EPU, or EPO, and the glaze of the second slidable finish can comprise EPS, EPP, EPU, or EPO. A first surface texture style on the first slidable finish can be identical to a second surface texture style on the first slidable finish. The protective helmet of claim can further comprise an outer shell and the outer energy management layer being disposed within the outer shell and the outer surface of the outer energy management layer being oriented towards the outer shell. A method of using the protective helmet can further comprise reducing an amount of energy transferred to a head of a user during a helmet impact by sliding the first slidable finish a distance past the second slidable finish at the time of impact.

In another aspect, a protective helmet for rotational energy management can comprise an outer energy management layer comprising an outer surface and an inner surface opposite the outer surface. The inner surface can comprise a first slidable finish. An inner energy management layer can be disposed within the outer energy management layer and further comprising an outer surface oriented towards the outer energy management layer and an inner surface opposite the outer surface. The outer surface can comprise a second slidable finish that directly contacts the first slidable finish. A space between the first slidable finish and the second slidable finish can be devoid of a lubricant and devoid of any interstitial slip layer to facilitate relative movement between the first slidable finish and the second slidable finish at a time of impact.

The helmet can further comprise the first slidable finish comprising a first glaze comprising a thickness less than or equal to 2 mm and the second slidable finish comprising a second glaze comprising a thickness less than or equal to 2 mm. The first slidable finish and the second slidable finish can comprise a surface texture skewness of less than or equal to 1 mm. The outer energy management layer can comprise EPS, EPP, EPU, or EPO, and the glaze of the first slidable finish can also comprising EPS, EPP, EPU, or EPO. The inner energy management layer can comprise EPS, EPP, EPU, or EPO, and the glaze of the second slidable finish can comprise EPS, EPP, EPU, or EPO. At least one of the first slidable finish and the second slidable finish can comprise an in-molded shell. The protective helmet can further comprise an outer shell, and the outer energy management layer can be disposed within the outer shell and the outer surface of the outer energy management layer can be oriented towards the outer shell. A method of using the protective helmet can further comprise reducing an amount of energy transferred to a head of a user during a helmet impact by sliding the first slidable finish a distance past the second slidable finish at the time of impact.

In another aspect, a protective helmet for rotational energy management can comprise an outer energy management layer comprising an outer surface and an inner surface opposite the outer surface. The inner surface can comprise a first slidable finish. An inner energy management layer can be disposed within the outer energy management layer and the inner energy management layer can further comprise an outer surface oriented towards the outer energy management layer and an inner surface opposite the outer surface. The outer surface can comprise a second slidable finish that directly contacts the first slidable finish.

The protective helmet can further comprise the first slidable finish comprising a first glaze comprising a thickness less than or equal to 2 mm, and the second slidable finish comprising a second glaze comprising a thickness less than or equal to 2 mm. The first slidable finish and the second slidable finish can comprise a surface texture skewness of less than or equal to 1 mm. The outer energy management layer can comprise EPS, EPP, EPU, or EPO, and the glaze of the first slidable finish can comprise EPS, EPP, EPU, or EPO. The inner energy management layer can comprise EPS, EPP, EPU, or EPO, and the glaze of the second slidable finish can comprise EPS, EPP, EPU, or EPO.

A space between the first slidable finish and the second slidable finish can be devoid of a lubricant and devoid of any interstitial slip layer to facilitate relative movement between the first slidable finish and the second slidable finish at a time of impact. The protective helmet can further comprise an outer shell, and the outer energy management layer can be disposed within the outer shell and the outer surface of the outer energy management layer can be oriented towards the outer shell.

DETAILED DESCRIPTION

Figure 1A:
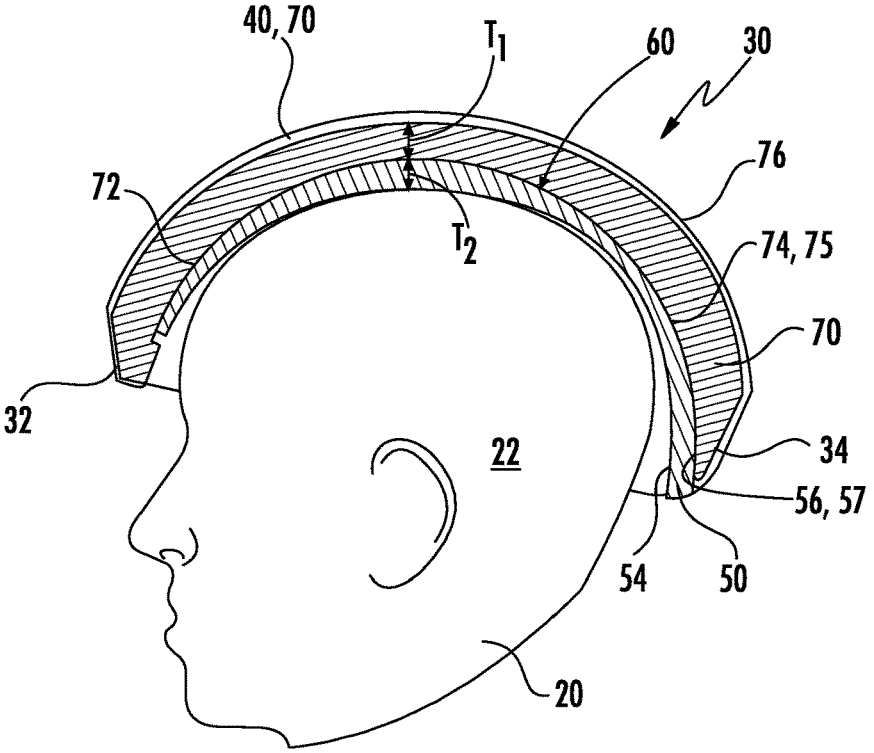
FIGS. 1A and 1B show various views of an embodiment of a helmet for rotational energy management.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular protective helmets are disclosed, such protective helmets and implementing components may comprise any shape, size, style, type, model, version, measurement, concentration, material, quantity, and/or the like as is known in the art for such protective helmets and implementing components, consistent with the intended operation of a protective helmet.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a protective helmet that can include an outer shell and inner and outer energy management or energy-absorbing layers, such as foam. The protective helmet can be a bike helmet used for mountain biking or road cycling, and can also be used for a skier, skater, hockey player, snowboarder, or other snow or water athlete, a football player, baseball player, lacrosse player, polo player, climber, auto racer, motorcycle rider, motocross racer, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that includes either single or multi-impact rated protective material base that is typically, though not always, covered on the outside by a decorative cover and includes comfort material on at least portions of the inside, usually in the form of comfort padding.

Generally, protective helmets, such as the protective helmets listed above, can comprise an outer shell and an inner energy management or energy-absorbing material. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

Although helmets have existed for a long time as a way to protect a wearer's head in the case of an impact, impact absorbing materials and the ways in which those materials have been used to manage impact force have significantly improved over the years, and the issue of rotational impact or indirect impact has been addressed only more recently.

Crash impacts have two main types of force—linear and rotational. Both are related to the majority of brain injuries. Linear forces can occur when the wearer's head is moving in a straight line and comes to a sudden stop or is struck by an object moving in a straight line. Rotational forces can occur when a wearer's head is struck at an angle or rotates quickly and comes to a sudden stop (like when the wearer skids along a road during a crash or hits his head on an object at an oblique angle (i.e., and angle that is not "straight on")). This can cause the brain to twist within the wearer's skull and become injured.

Conventional helmets have generally been formed to follow a contour of the inner surface of the helmet, typically an oblong shape that matches or closely matches the shape of a typical human head. Applicant has observed that to these conventional helmets, additional "slip" layers have been added within the helmet to follow the same contour and shape of the internal surface of the helmet and to manage energy in rotational impacts. When rotational forces impact the outer shell of the helmet, the slip layer facilitates shifting in relation to the innermost part of the helmet or the user's head to reduce the rotational forces on the wearer's head. Applicant has noted that even slight reductions in rotational forces can make a significant reduction in the severity of injuries.

Conventional helmets having multiple energy management liners require a lubricant or an extra layer between the energy management liners in order for the two energy management liners to slip or rotate effectively against one another. Contemplated as part of this disclosure are protective helmets having multiple energy management liners devoid of any lubricant or additional layer between the liners, but nonetheless configured to slip or rotate effectively against one another upon impact. Specifically, by creating a surface texture on at least one of the inner surface of the outer liner of energy management material and the outer surface of the inner liner of energy management material, the rotational energy transferred to the head is reduced by creating a low friction interface between the interfacing surfaces of the outer liner and the inner liner.

Figure 1B:
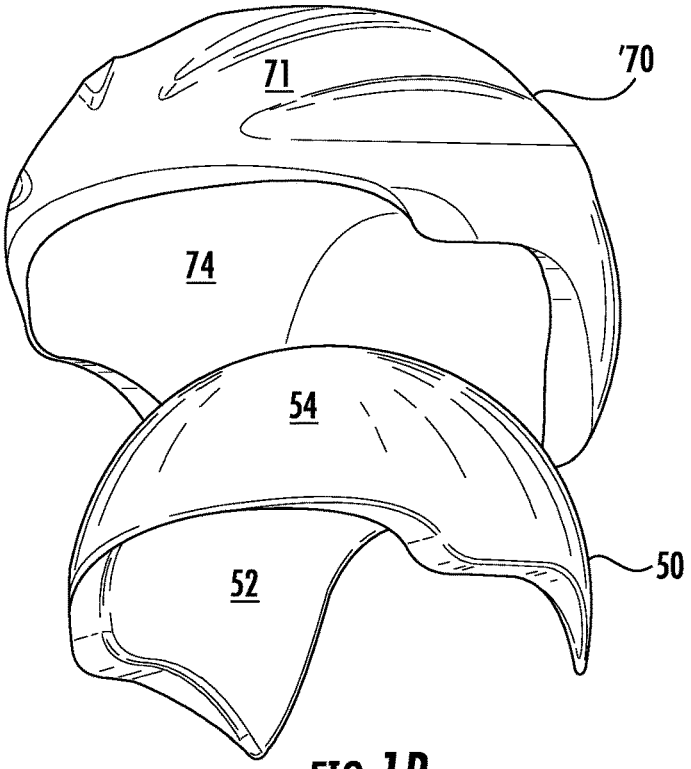

FIGS. 1A and 1B show various views of a helmet 30 for managing rotational energy management during impacts that is being worn by a user 20 to protect the head 22 of the user 20. FIG. 1A shows a non-limiting example of cross-sectional side view of the helmet 30, with a front 32 of the helmet 30 shown at the left of the figure and the back or rear 34 of the helmet 30 shown at the right of the figure. The helmet 30 can comprise an outer shell 40, an inner energy management layer or impact liner 50, and an outer energy management layer or impact liner 70. The outer shell 40 can, without limitation, be formed of a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The outer shell 40 can be stamped, in-molded, injection molded, vacuum formed, or formed by another suitable process. The outer shell 40 can provide a shell into which the energy management layers 50, 70 can be disposed. The outer shell 40 can also provide a smooth aerodynamic finish, a decorative finish, or both, for improved performance, improved aesthetics, or both. As a non-limiting example, the outer shell 40 can comprise PC shell that is in-molded in the form of a vacuum formed sheet, or is attached to the outer energy management layer 70 with an adhesive. The outer shell 40 can also be permanently or releasably coupled to the outer energy management layer 70, using any suitable chemical or mechanical fastener or attachment device or substance including without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners.

As shown in FIG. 1A, the helmet 30 can comprise at least an outer energy management layer or impact liner 70 and an inner energy management layer or impact liner 50. For convenience, the present disclosure shows the helmet 30 comprising two energy management layers 50, 70, but also encompasses helmets 30 that also comprise more than two energy management layers, such as three, four, or any suitable number of energy management layers.

The outer energy management layer 70 can comprise an outer surface 76 oriented towards the outer shell 40, if present, and away from the user 22. The outer energy management layer 70 can further comprise and an inner surface 74 opposite the outer surface 76, which can be oriented towards a head 22 of the user 20. Similarly, the inner energy management layer 50 comprises an outer surface 56 oriented towards the outer energy management layer 70, and an inner surface 54 opposite the outer surface 56, which can be oriented towards the head 22 of the user 20.

The energy management layers 50, 70 can be made or formed of the same or similar materials, including plastic, polymer, foam, or other suitable energy-absorbing material or impact liner to absorb, deflect, or otherwise manage energy and to contribute to energy management for protecting a wearer during impacts. The outer energy management layers 50, 70 can include, without limitation, EPS, EPP, EPU, EPO, or other suitable material. As indicated above, in-molded helmets can be formed with the outer shell 40 of the helmet being bonded directly to the energy management layer, such as 50, 70, by expanding foam into a shell, such as the outer shells 40, 52, and 72. As such, the energy management layers 50, 70 can, in some embodiments, be in-molded into outer shells 52 and 72, respectively, as single monolithic bodies of energy management material. Alternatively, in other embodiments the energy management layers 50, 70 can be formed of multiple portions or a plurality of portions. In any event, the energy management layers 50, 70 can absorb energy or manage energy from an impact by bending, flexing, crushing, or cracking, and as described in greater detail below, by sliding, rotating, slipping, or otherwise moving relative to one another.

The outer energy management material 70 (including the integrally formed first slidable finish 75) can comprise a thickness $T_1$, measured in a radial direction from a center of the helmet 30 to an outer edge of the helmet, in a range of 5-40 mm, 5-25 mm, or 8-15 mm. The inner energy management material 50 (including the integrally formed first slidable finish 57) can comprise a thickness $T_2$, measured in a radial direction from a center of the helmet 30 to an outer edge of the helmet, in a range of 5-40 mm, 5-25 mm, or 8-15 mm.

The inner surface 74 of the outer energy management layer 70 can comprise a first slidable finish 75, which can comprise a first glaze comprising a thickness less than or equal to 2 mm. In other instances, the first glaze 75 can comprise a thickness less than or equal to 1 mm. Similarly, the outer surface 56 of the inner energy management layer 50 can comprise a second slidable finish 57 comprising a second glaze comprising a thickness less than or equal to 2 mm. In other instances, the second glaze 57 can comprise a thickness less than or equal to 1 mm.

As a person having ordinary skill in the art will appreciate, when the term "slidable finish" is used herein, such as for the first slidable finish 75 and the second slidable finish 57, the term slidable finish does not mean that the finish itself moves or slides on or relative to the energy management layer of which it is a part, such as layers 70 and 50, respectively. Instead, the finish is part of, or fixed relative to, its respective energy management layer, and facilitates or provides for sliding and relative movement with respect to adjacent layers, such as sliding or relative movement between the first slidable finish 75 and the second slidable finish 57 and the inner energy management layer or impact liner 50 and the outer energy management layer or impact liner 70.

The inner energy management layer 50 can be disposed within the outer energy management layer 70 with the second slidable finish 57 oriented towards the first slidable finish 75 of the outer energy management layer 70. The inner management layer 50 can comprise inner surface 74 opposite the outer surface 76 or the first slidable finish 75, wherein the outer surface 76 and the first slidable finish 75 are the same surface. The second slidable finish 57 can directly contact the first slidable finish 57. As such, a space or interface 60 between the first slidable finish 75 and the second slidable finish 57 can be negligible and devoid of any lubricant and devoid of any interstitial slip layer that would facilitate relative movement between the first slidable finish 75 and the second slidable finish 57 at a time of impact. Additionally, the interface 60, like the first slidable finish 75 and the second slidable finish 57, can be spherical or substantially spherical in shape such that to facilitate the relative movement, slipping, sliding, and rotation between the first slidable finish 75 and the second slidable finish 57 and the inner layer 50 and the outer layer 70. While the inner liner 50 is, for convenience, described as "inner" because of its relative position with the outer energy management layer 70, and its relative position with the outer shell 40, the inner energy management layer 50 can be, but need not be, the innermost layer, and additional layers can be present.

The first slidable finish 75 can comprise a first glaze comprising glazed EPS, glazed EPP, glazed EPU, glazed EPO, or any other suitable material, including a same material from which the outer energy management layer 70 is formed. The first slidable finish 75 can also comprise textured EPS, textured EPP, textured EPU, textured EPO, in-molded PC, and brushed nylon slide enablers. When the first slidable finish 75 comprises an in-molded PC shell or similar, the shell can be used both for in-molding the outer energy management layer 70 and as the first slidable finish 75 so that there is a shell formed as the first slidable finish 75. The texture of the first slidable finish 75 can be anywhere from a matte finish to a very high gloss finish depending on the treatment. The treatment can result from the texture of the tool during molding, as well as a post molding process, whether mechanical or chemical, which can include using a laser or other patterning device to etch a pattern or texture onto the first slidable finish 75. After forming the first slidable finish 75 as a glaze, it can be impossible, nearly impossible, impractical, or cost or process prohibitive to remove the glazed surface 75 from the outer layer 70 without destroying both, the outer layer 70 and the first slidable finish 75 being perfectly or well bonded together. The first slidable finish 75 can comprise a skewness (or a difference between high points and low points across the finish 75) that is less than or equal to 1 mm. The texture can cover the entire surface of the energy management layer 70 or at an entire interface 60, but can also cover less than an entirety of the energy management layer 70 depending on the application.

The second slidable finish 57 can comprise a second glaze comprising glazed EPS, glazed EPP, glazed EPU, glazed EPO, or any other suitable material, including a same material from which the inner energy management layer 50 is formed. The first slidable finish 75 can also comprise textured EPS, textured EPP, textured EPU, textured EPO, in-molded PC, and brushed nylon slide enablers. When the second slidable finish 57 comprises an in-molded PC shell or similar, the shell can be used both for in-molding the inner energy management layer 50 and as the second slidable finish 57 so that there is a shell formed as the second slidable finish 57. The texture of the second slidable finish 57 can be anywhere from a matte finish to a very high gloss finish depending on the treatment. The treatment can result from the texture of the tool during molding, as well as a post molding process, whether mechanical or chemical, which can include using a laser or other patterning device to etch a pattern or texture onto the second slidable finish 57. After forming the second slidable finish 57 as a glaze, it can be impossible, nearly impossible, impractical, or cost or process prohibitive to remove the glazed surface 57 from the inner layer 50 without destroying both, the outer layer 50 and the second slidable finish 57 being perfectly or well bonded together.

The second slidable finish 57 can comprise a second surface texture style that is the same or identical to the first surface texture style, while in other instance the surface texture style can differ, or be formed on only one of the energy management layers 50, 70. Thus, the second slidable finish 57 can also comprise a skewness (or a difference between high points and low points across the finish 57) that is less than or equal to 1 mm. The texture can cover the entire surface of the energy management layer 50 or at an entire interface 60, but can also cover less than an entirety of the energy management layer 50 depending on the application. In any event, the interface 60 can be formed as a low friction interface, with a low or minimized coefficient of friction to facilitate the relative movement and rotation between the inner surface 74, or slidable surface 75, of the outer energy management liner 70 and the outer surface 56, or slidable surface 57, of the inner energy management liner 50.

Sliding, slipping, or rotational movement between the inner energy management layer or impact liner 50 and the outer energy management layer or impact liner 70 without lubricant and without an interstitial slip layer can be further aided by the interface 60, the first slidable finish 75 of the inner surface 74, and the second slidable finish 57 of the outer surface 56 being smooth, planar, and uniform without interlocking pieces, ridges, channel, ribs, crenulations, flanges, or other rough, unsmooth, or non-planar features to prevent relative movement or sliding.

The helmet 30 can further comprise vents or openings 42 that are formed in, and extend through, a portion or entirety of the helmet 30, including the outer shell 40, the outer energy management layer 70, and the inner energy management layer 50, as shown. As such, the vents 32 can be comprised of a plurality of vents or vent segments, including vents or openings 42 formed in the outer shell 40 that form, comprise, or align with at least a portion of the vents 32. The vents 32 can also be comprised of vents or openings 62 formed in the outer energy management layer 70 that form, comprise, or align with at least a portion of the vents 42. Similarly, the vents 32 can also be comprised of vents or openings 82 that can be formed in the inner energy management layer 50 that form, comprise, or align with at least a portion of the vents 42, vents 62, or both. The vents 32 can allow for airflow and circulation of air from outside the helmet 30 into the helmet 30 and adjacent the head 22 of the user 20 to cool the user 20 and provide ventilation. When the vents 42 are present, the relative movement of the helmet 30 along the interface 60 can be unimpeded.

The helmet 30 can also comprise straps or webbing that can be attached to the helmet 30 and can be used to couple or releasably attach the helmet 30 to the head 22 of the user 20. The helmet 30 can also comprise masks, visors, optional comfort liners, and other features known in the art to be associated with, or coupled to, helmets.

The optional comfort liner or fit liner can also be disposed within, and coupled to, the helmet 30. The comfort liner can be disposed inside the inner energy management layer 50. The comfort liner 46 can be made of textiles, plastic, foam, polyester, nylon, or other suitable materials. The comfort liner 46 can be formed of one or more pads of material that can be joined together, or formed as discrete components, that are coupled to the helmet 30. The comfort liner can be releasably or permanently attached to the helmet 30, such as to the inner energy management layer 50, using an adhesive, permanent adhesive, PSA, foam-core adhesive, tape, two-sided tape, mounting foam adhesive, fastener, clip, cleat, cutout, tab, snap, rivet, hog ring, or hook and loop fasteners, or other interlocking surfaces, features, or portions. As such, the comfort liner can provide a cushion and improved fit for the wearer of the in-molded helmet.

FIG. 1B shows a perspective view of the outer energy management layer 70 from FIG. 1A disposed over, and offset from, the inner energy management layer 50 from FIG. 1A. As noted above, the outer surface 56 of the inner layer 50, the inner surface 74 of the outer layer 70, or both, can be configured to provide effective slip or rotation relative to one another without the need of a lubricant or additional layer between the two liners of energy management material. According to some aspects, at least one of the outer surface 56 of the inner layer 50 and the inner surface 74 of the outer liner 70, or both, can comprise the surface finishes 57, 75, respectively that reduces the friction between the two of energy management layers 50, 40. The surface finishes 57, 75 may comprise annealed surfaces, and surfaces on either the inner energy management liner 50, the outer energy management liner 70, or both, can also be annealed. In some embodiments, the surface finish may comprise any smoothing, hardening, or any combination of smoothing and hardening of the energy management layer 50, 70 and surfaces thereof.

In particular embodiments, the respective shapes of the inner 50 and outer 70 energy management material surfaces can further assist in the slipping within the helmet 30 and the movement along the interface 60. For example, the outer surface 56 of the inner energy management material 50 may be spherical (meaning it has a common radius of curvature in places where it contacts the inner surface 74 of the outer energy management material 70), and the inner surface 74 of the outer energy management material 70 may also be spherical (meaning it has a common radius of curvature in places where it contacts the outer surface 56 of the inner energy management material 50). Having the same radius of curvature on mating surfaces (at interface 60) further assists in reducing the friction coefficient of the surfaces without the need to add additional materials between the energy management material surfaces.

Although the term "spherical" is used in this disclosure, it will be clear to one of ordinary skill in the art that the surfaces referenced, including surfaces 56, 74 need not be full, complete spheres and that a portion of a spherical surface can be used to the extent the portion is needed. Thus, where "spherical" is used herein, the term can mean that the surface has a substantially consistent radius of curvature throughout the surface and in some embodiments to wherever the surface and layer extends, but at least for a majority of the extent of the surface. A substantially consistent radius of curvature means that the radius of curvature is between 70%-100% of a constant radius of curvature throughout the spherical surface, or within 30% of a radius of curvature of a majority of the spherical surface. In particular embodiments, the spherical surface can be a completely consistent radius of curvature, or within 5% of a constant radius of curvature. In other particular embodiments, the spherical surface can have portions similar in shape to a typical headform and other portions that have a substantially consistent radius of curvature throughout the portions of the spherical surface. The spherical surfaces, where used, may also be discontinuous and include gaps between sections of a spherical surface within a common spherical plane, or may be on different spherical planes.

While FIG. 1B shows the outer energy management layer 70 and the inner energy management layer 50 as being vertically separated by a gap or space while aligned with respect to each other, for ease of illustration, the energy management layers 50, 70 are adjacent one another and in contact during use of the helmet 30. A space between the inner surface 74 of the outer energy management material 70 and the outer surface 56 of the inner energy management material 50 can be devoid of lubricant and additional interstitial layers, while still facilitating (or being configured to facilitate) relative movement between the inner surface 74 of the outer energy management material 70 and the outer surface 56 of the inner energy management material 50 upon impact or during a collision of the helmet 30.

Figure 2A:
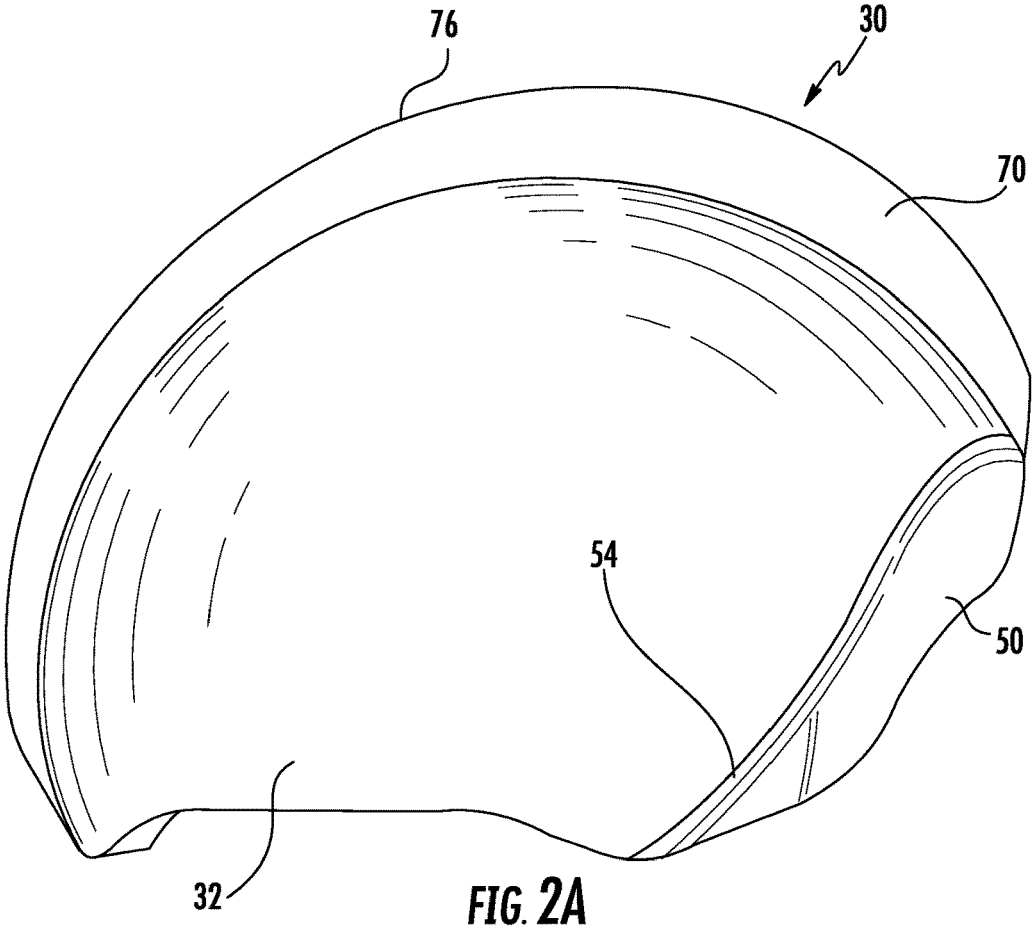
FIGS. 2A and 2B show various views of another embodiment of a helmet for rotational energy management.
Figure 2B:
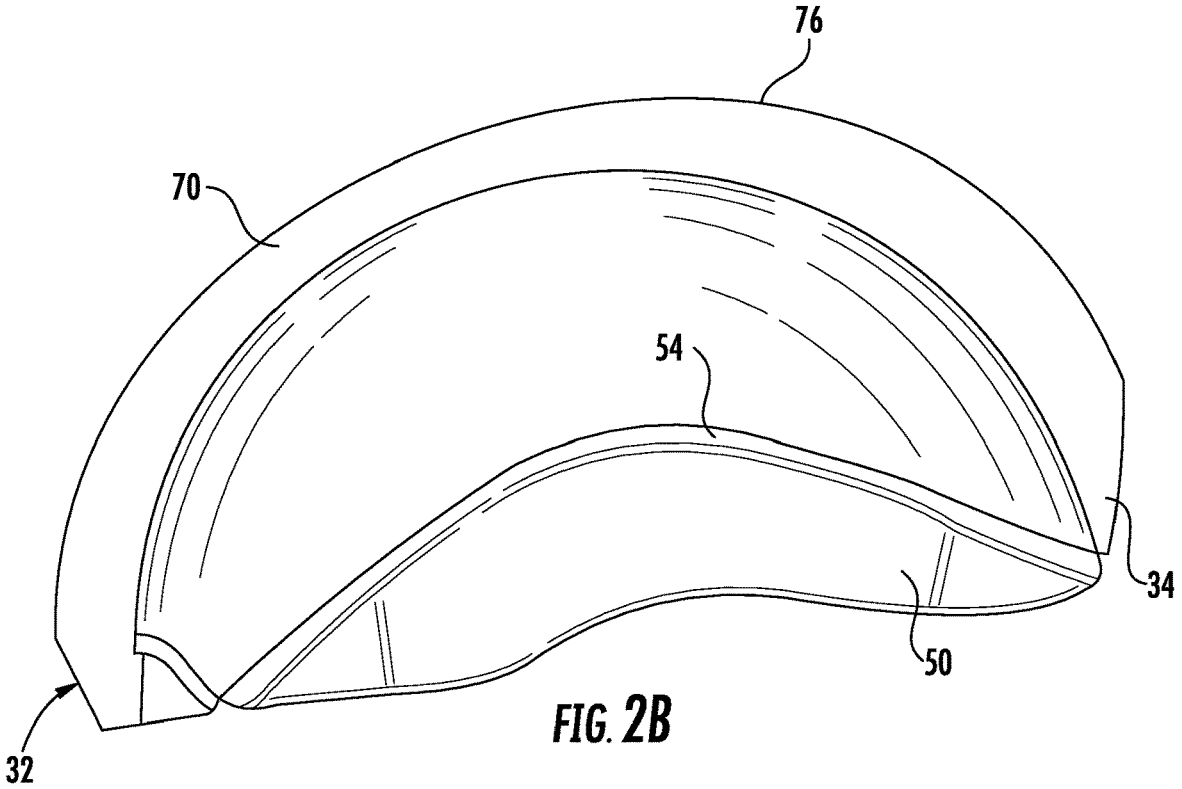

FIGS. 2A and 2B show non-limiting example of the helmet 30 according to another embodiment of the helmet. FIG. 2A shows a perspective view of the helmet 30 with the front 32 of the helmet shown at the front left of the figure, while FIG. 2B shows a side profile view of the helmet 30 with the front 32 of the helmet disposed at the left of the figure and the back 34 of the helmet 30 shown at the right of the figure.

Figure 3A:
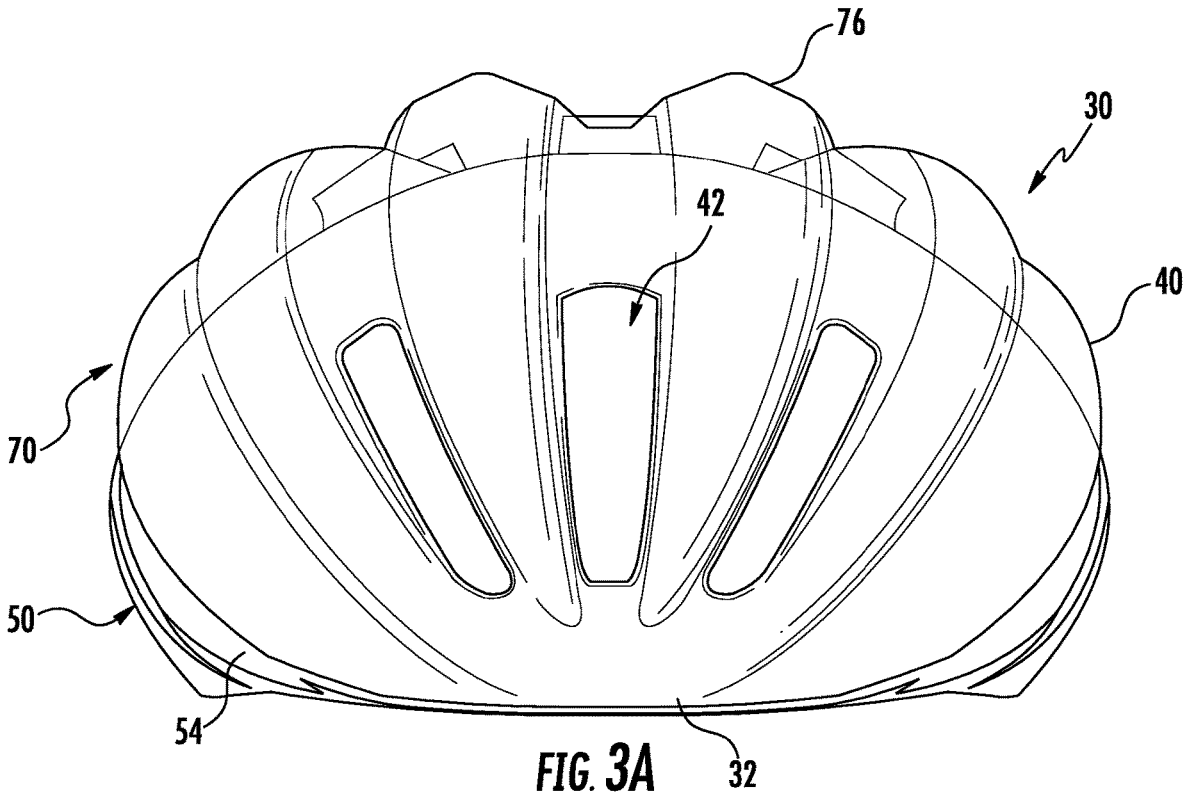
FIGS. 3A and 3B show various views of another embodiment of a helmet for rotational energy management.
Figure 3B:
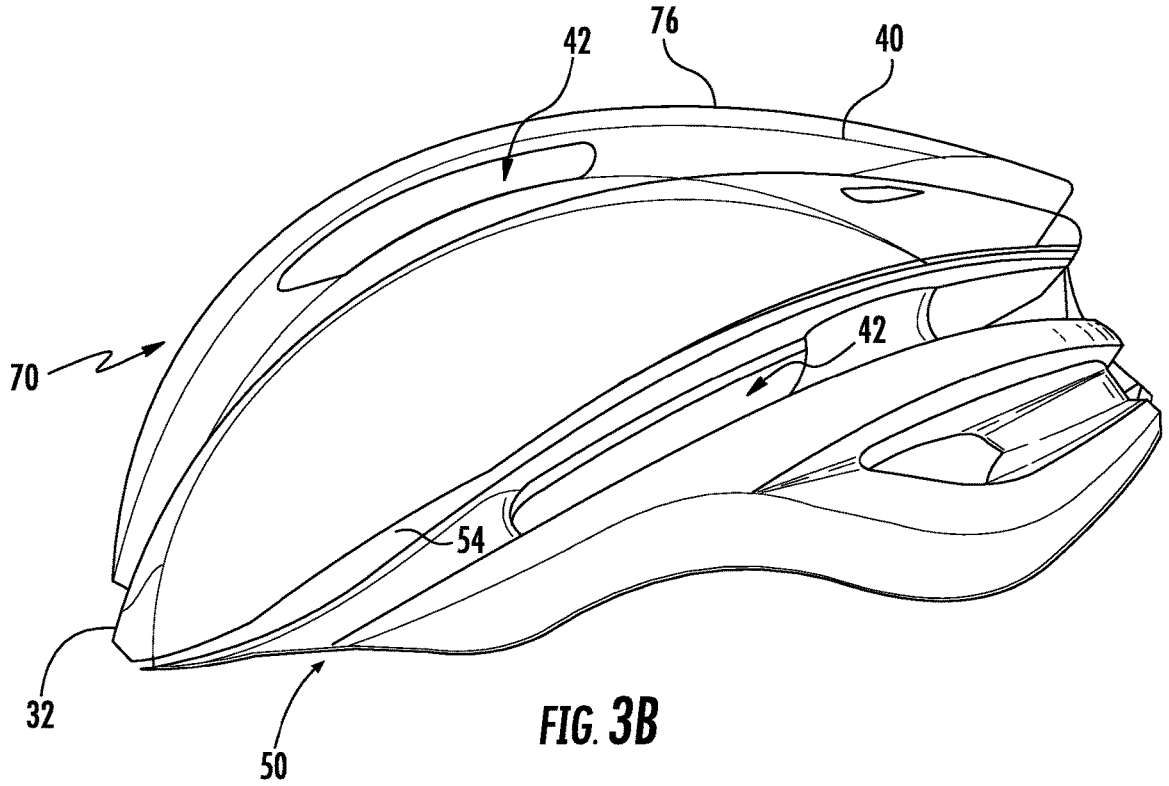

FIGS. 3A and 3B show another non-limiting example of the helmet 30 according to another embodiment of the helmet. FIG. 3A shows a front profile view of the helmet 30, while FIG. 3B shows a side profile view of the helmet 30 with the front 32 of the helmet disposed at the left of the figure and the back 34 of the helmet 30 shown at the right of the figure.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A protective helmet for rotational energy management, comprising:

an outer energy management layer formed of a first material and comprising a first lateral side and a second lateral side, and an outer surface of the outer energy management layer and an inner surface of the outer energy management layer opposite the outer surface of the outer energy management layer, wherein the inner surface of the outer energy management layer comprises an integrally formed first slidable finish, the first slidable finish comprising a first glaze of the first material such that the first slidable finish is part of and not removable from the outer energy management layer; and an inner energy management layer formed of a second material and disposed within the outer energy management layer and further comprising an outer surface of the inner energy management layer oriented towards the outer energy management layer and an inner surface inner energy management layer opposite the outer surface of the inner energy management layer, wherein the outer surface of the inner energy management layer extends continuously from the first lateral side to the second lateral side of the outer energy management layer, and wherein the outer surface of the inner energy management layer comprises an integrally formed second slidable finish that directly contacts the first slidable finish, the second slidable finish comprising a second glaze of the second material such that the second slidable finish is part of and not removable from the inner energy management layer;

wherein the first slidable finish is configured to directly mate with the second slidable finish to form a low friction interface between the inner surface of the outer energy management layer and the outer surface of the inner energy management layer; and wherein the first slidable finish and the second slidable finish are configured to move relative to each other along the low friction interface in response to an impact.

2. The protective helmet of claim 1, wherein:

the first glaze comprises a thickness less than or equal to 1 millimeter (mm); and the second glaze comprises a thickness less than or equal to 1 mm.

3. The protective helmet of claim 2, wherein the first slidable finish and the second slidable finish each comprise a surface texture skewness of less than or equal to 1 mm.

4. The protective helmet of claim 3, wherein:

the outer energy management layer comprises expanded polystyrene (EPS), expanded polypropylene (EPP), expanded polyurethane (EPU), or expanded polyolefin (EPO);

the glaze of the first slidable finish comprises EPS, EPP, EPU, or EPO;

the inner energy management layer comprises EPS, EPP, EPU, or EPO; and the glaze of the second slidable finish comprises EPS, EPP, EPU, or EPO.

5. The protective helmet of claim 1, wherein a first surface texture style on the first slidable finish is identical to a second surface texture style on the second slidable finish.

6. The protective helmet of claim 1, further comprising:

an outer shell; and the outer energy management layer disposed within the outer shell and the outer surface of the outer energy management layer oriented towards the outer shell.

7. The protective helmet of claim 1, wherein the first slidable finish is configured to slide a distance past the second slidable finish along the low friction interface in response to a helmet impact to thereby reduce an amount of energy transferred to a head of a user.

8. A protective helmet for rotational energy management, comprising:

an outer energy management layer formed of a first material and comprising a first lateral side and a second lateral side, and an outer surface of the outer energy management layer and an inner surface of the outer energy management layer opposite the outer surface of the outer energy management layer, wherein the inner surface of the outer energy management layer comprises an integrally formed first slidable finish, the first slidable finish being part of and not removable from the outer energy management layer; and an inner energy management layer formed of a second material and disposed within the outer energy management layer and further comprising an outer surface of the inner energy management layer oriented towards the outer energy management layer and an inner surface of the inner energy management layer opposite the outer surface of the inner energy management layer, wherein the outer surface of the inner energy management layer extends continuously from the first lateral side to the second lateral side of the outer energy management layer, and wherein the outer surface of the of the inner energy management layer comprises an integrally formed second slidable finish that directly contacts the first slidable finish, the second slidable finish being part of and not removable from the inner energy management layer, wherein the first slidable finish is configured to directly mate with the second slidable finish to form a low friction interface between the inner surface of the outer energy management layer and the outer surface of the inner energy management layer, and wherein the first slidable finish and the second slidable finish are configured to move relative to each other along the low friction interface in response to an impact.

9. The protective helmet of claim 8, wherein:

the first slidable finish comprises a first glaze comprising a thickness less than or equal to 2 mm; and the second slidable finish comprises a second glaze comprising a thickness less than or equal to 2 mm.

10. The protective helmet of claim 9, wherein the first slidable finish and the second slidable finish each comprise a surface texture skewness of less than or equal to 1 mm.

11. The protective helmet of claim 10, wherein:

the outer energy management layer comprises expanded polystyrene (EPS), expanded polypropylene (EPP), expanded polyurethane (EPU), or expanded polyolefin (EPO);

the glaze of the first slidable finish comprises EPS, EPP, EPU, or EPO;

the inner energy management layer comprises EPS, EPP, EPU, or EPO; and the glaze of the second slidable finish comprises EPS, EPP, EPU, or EPO.

12. The protective helmet of claim 8, further comprising:

an outer shell; and the outer energy management layer disposed within the outer shell and the outer surface of the outer energy management layer oriented towards the outer shell.

13. The protective helmet of claim 8, wherein the first slidable finish is configured to slide a distance past the second slidable finish along the low friction interface in response to a helmet impact to thereby reduce an amount of energy transferred to a head of a user.

14. A protective helmet for rotational energy management, comprising:

an outer energy management layer formed of a first material and comprising a first lateral side and a second lateral side, and an outer surface of the outer energy management layer and an inner surface of the outer energy management layer opposite the outer surface of the outer energy management layer, wherein the inner surface of the outer energy management layer comprises an integrally formed first slidable finish, the first slidable finish being part of and not removable from the outer energy management layer; and an inner energy management layer formed of a second material and disposed within the outer energy management layer and further comprising an outer surface of the inner energy management layer oriented towards the outer energy management layer and an inner surface of the inner energy management layer opposite the outer surface of the inner energy management layer, wherein the outer surface of the inner energy management layer extends continuously from the first lateral side to the second lateral side of the outer energy management layer, and wherein the outer surface of the inner energy management layer comprises an integrally formed second slidable finish that directly contacts the first slidable finish to form a low friction interface between the inner surface of the outer energy management layer and the outer surface of the inner energy management layer, the second slidable finish being part of and not removable from the inner energy management layer.

15. The protective helmet of claim 14, wherein:

the first slidable finish comprises a first glaze comprising a thickness less than or equal to 2 mm; and the second slidable finish comprises a second glaze comprising a thickness less than or equal to 2 mm.

16. The protective helmet of claim 15, wherein the first slidable finish and the second slidable finish each comprise a surface texture skewness of less than or equal to 1 mm.

17. The protective helmet of claim 16, wherein:

the outer energy management layer comprises expanded polystyrene (EPS), expanded polypropylene (EPP), expanded polyurethane (EPU), or expanded polyolefin (EPO);

the glaze of the first slidable finish comprises EPS, EPP, EPU, or EPO;

the inner energy management layer comprises EPS, EPP, EPU, or EPO; and the glaze of the second slidable finish comprises EPS, EPP, EPU, or EPO.

18. The protective helmet of claim 16, wherein a space between the first slidable finish and the second slidable finish is devoid of a lubricant and devoid of any interstitial slip layer to facilitate relative movement between the first slidable finish and the second slidable finish at a time of impact.

19. The protective helmet of claim 14, further comprising:

an outer shell; and the outer energy management layer disposed within the outer shell and the outer surface of the outer energy management layer oriented towards the outer shell.

20. The protective helmet of claim 14, wherein the first slidable finish is configured to slide a distance past the second slidable finish along the low friction interface in response to a helmet impact to thereby reduce an amount of energy transferred to a head of a user.

* * * * *